US007340893B1

(12) United States Patent
Rowan

(10) Patent No.: US 7,340,893 B1
(45) Date of Patent: Mar. 11, 2008

(54) STEAM GENERATOR SYSTEM

(76) Inventor: James A. Rowan, 11 Hunter's Court, Fonthill, On. (CA) L05 1E4

( * ) Notice: Subject to any disclaimer, the term of this patent is extended or adjusted under 35 U.S.C. 154(b) by 322 days.

(21) Appl. No.: 10/998,265

(22) Filed: Nov. 26, 2004

Related U.S. Application Data

(60) Provisional application No. 60/571,459, filed on May 14, 2004, provisional application No. 60/592,568, filed on Jul. 30, 2004.

(51) Int. Cl.
*F03C 1/00* (2006.01)

(52) U.S. Cl. ..... 60/495; 60/496; 60/682

(58) Field of Classification Search ..... 60/398, 60/495, 496, 682
See application file for complete search history.

(56) References Cited

U.S. PATENT DOCUMENTS 1,675,347 A * 7/1928 Featherstone et al. ..... 122/32
3,913,560 A * 10/1975 Lazarre et al. ..... 126/360.1
5,544,624 A * 8/1996 Xiong ..... 122/4 D
5,765,964 A * 6/1998 Calcote et al. ..... 405/128.55
2004/0058230 A1* 3/2004 Hsu ..... 429/62

* cited by examiner

*Primary Examiner*—Hoang Nguyen
(74) *Attorney, Agent, or Firm*—Robert C. Curfiss

(57) ABSTRACT

A steam generator includes a submersible burner compartment with at least one burner subassembly and an associated submersible primary ignition means. The burner subassembly also has an associated infrared primary flame monitoring subassembly. The primary flame monitoring system and primary ignition means are all housed within the burner compartment whereby when the burner compartment is filled with water, the burners are all submerged. The infrared flame monitoring subassembly is electronically coupled to a primary monitoring device and a fuel feed pipe is couple to the burner subassembly. A super heater compartment is coupled to and receives steam exhausted from the burner compartment. The super heater compartment has at least one burner subassembly located therein. An associated submersible secondary ignition means and an associated infrared secondary flame monitoring subassembly are provided for each burner subassembly. The burner, secondary ignition means and infrared secondary monitoring subassembly are all housed within the super heater compartment with the infrared subassembly electronically coupled to a secondary monitoring device.

12 Claims, 7 Drawing Sheets

Whole system with Decision Points

Whole system with Explanatory Notes

Emergency Power

This system is an emergency power system. It is primarily used to provide power when the grid cannot. It can, however, provide ongoing revenue to pay for the equipment for sales of Hydrogen for $H_2$ vehicle fuel. The Hydrogen is continuously replenished; therefore the system is always ready in case of a power failure.

Grid Replacement with Internal Combustion Engine Generator

This is a grid replacement system using ICE electricity generators. The primary focus is on providing power to the Local Draw. Selling *surplus* electricity, hydrogen or oxygen gas is a possibility if supply and commodity prices make such sales profitable.

Grid Replacement with Hydrogen-Oxygen fuelrd immersion boiler,

Grid Energy Storage

STEAM GENERATOR SYSTEM

CROSS REFERENCE TO RELATED APPLICATION

The present application is based upon Provisional Patent Application Ser. Nos. 60/571,459 filed May 14, 2004 and 60/592,568 filed Jul. 30, 2004 and incorporates by reference those applications.

BACKGROUND OF THE INVENTION

1. Field of the Invention

The present invention relates to a Steam Generator System and more particularly pertains to generating steam using submersible burners.

2. Discussion of the Prior Art

The use of steam generators of known configurations and apparatuses is known in the prior art. More specifically, steam generators of known configurations and apparatuses previously devised and utilized for the purpose of generating steam as a source of power are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,312,699 and U.S. Pat. No. 6,211,643 disclose storing energy in the form of hydrogen. The latter patent to Kagatani uses additionally a photovoltaic array or windmill to provide surplus electricity. The former patent to Yanagi also uses some of the heat created in a heat-exchanger system to provide heating and/or cooling.

The steam generating system as described herein is a departure from the conventional wisdom of boiler making where the flame or heat source is separated from the fluid by a wall of steel. In the present invention the flame is immersed in the water where all the heat generated by the burning of hydrogen and oxygen is captured by the surrounding water. While other fluids may be used, water should be the least expensive and most abundant fluid available. Flame/water separated boilers, such as those described by Munday, U.S. Pat. No. 5,279,260, generate waste heat and pollutants. The present invention produces little, if any, waste heat, and a minimal amount of pollutants, such as nitric oxide (NOX).

While these devices fulfill their respective, particular objectives and requirements, the aforementioned patents do not describe a steam generator system that allows a user to safely and efficiently produce steam.

In this respect, the steam generator system according to the present invention substantially departs from the conventional concepts and designs of the prior art, and in doing so provides an apparatus primarily developed for the purpose of generating steam using submersible burners.

Therefore, it can be appreciated that there exists a continuing need for a new and improved steam generator system which can be used for generating steam using submersible burners. In this regard, the present invention substantially fulfills this need.

SUMMARY OF THE INVENTION

In view of the foregoing disadvantages inherent in the known types of steam generators of known configurations and apparatuses now present in the prior art, the present invention provides an improved steam generator system. As such, the general purpose of the present invention, which will be described subsequently in greater detail, is to provide a new and improved steam generator system and method which has all the advantages of the prior art and none of the disadvantages.

To attain this, the present invention essentially comprises a submersible burner compartment having a lower portion, a shaft portion, and an upper portion. The lower portion has a cylindrical configuration with a water feed pipe whereby water may enter a lower portion and fill the burner compartment. The shaft portion is coupled to the lower portion in an orientation that is perpendicular to the water feed pipe. The shaft portion has a hollow tubular configuration.

At least one burner subassembly is provided and has an associated submersible primary ignition means in the shaft portion. The burner subassembly also has an associated infrared primary flame monitoring subassembly. The primary flame monitoring system and primary ignition means are all housed within the shaft portion whereby when the shaft portion is filled with water, the burners are all submerged, the infrared flame monitoring subassembly is electronically coupled to a primary monitoring device and a fuel feed pipe is couple to the burner subassembly.

The upper portion of the burner compartment has a cylindrical configuration with at least one baffle plate located therein. The upper portion has a steam exhaust pipe coupled thereto.

A super heater compartment has a generally hollow tubular configuration with a lower end and an upper end and with the steam exhaust pipe coupled to the lower end of the super heater compartment thereby providing a passageway for steam from the burner compartment to the super heater compartment. The super heater compartment has at least one burner subassembly located therein.

An associated submersible secondary ignition means and an associated infrared secondary flame monitoring subassembly are provided for each burner subassembly. The burner, secondary ignition means and infrared secondary monitoring subassembly are all housed within the super heater compartment with the infrared subassembly electronically coupled to a secondary monitoring device.

It is therefore an object of the present invention to provide a new and improved steam generator system which has all of the advantages of the prior art steam generators of known configurations and apparatuses and none of the disadvantages.

It is another object of the present invention to provide a new and improved steam generator system which may be easily and efficiently manufactured.

It is further object of the present invention to provide a new and improved steam generator system which is of durable land reliable constructions.

Another object of the present invention is to provide a new and improved steam generator system which is susceptible of a low cost of manufacture with regard to both materials and labor, and which accordingly is then susceptible of low prices of sale to the consuming public, thereby making such steam generator system economically available to the buying public.

Lastly, it is an object to the present invention to provide a submersible burner compartment having a lower portion, a shaft portion, and an upper portion. The lower portion has a water feed pipe whereby water may enter a lower portion and fill the burner compartment. The shaft portion being coupled to the lower portion. At least one burner subassembly with an associated submersible primary ignition means in the shaft portion is provided. The burner subassembly also has an associated infrared primary flame monitoring subassembly. The primary monitoring system and primary flame ignition means are all housed within the shaft portion of the submersible burner compartment, whereby when the shaft portion is filled with water, the burners are all submerged, the infrared subassembly is electronically coupled to a monitoring device with the burner assembly having a fuel feed pipe coupled thereto.

These together with other objects of the invention, along with the various features of novelty which characterize the invention, are pointed out with particularity in the claims annexed to and forming a part of this disclosure. For a better understanding of the invention, it operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes a reference to the annexed drawings and graphical representations.

The same reference numerals refer to the same parts throughout the various Figures.

DESCRIPTION OF THE PREFERRED EMBODIMENT

Figure 7:
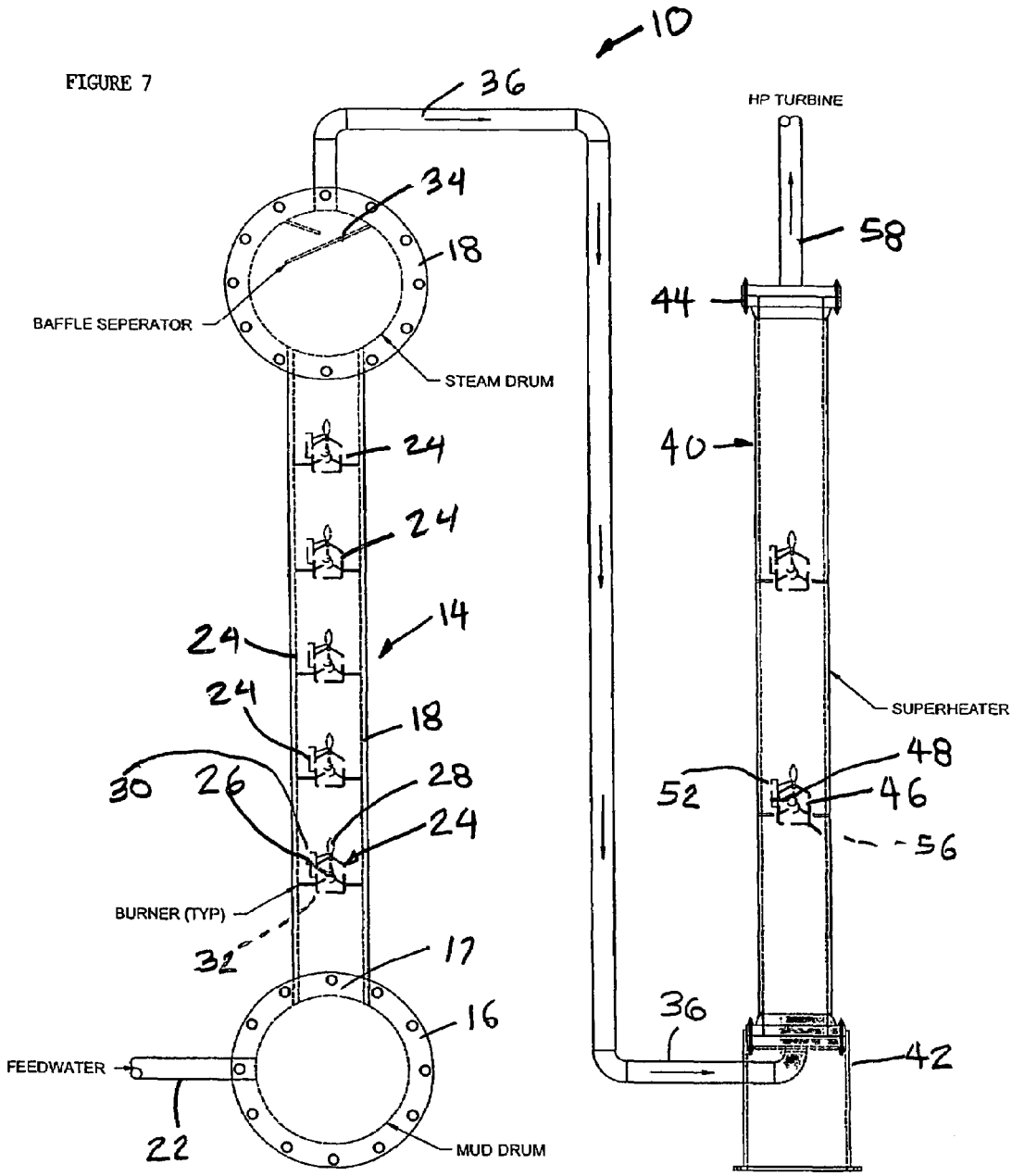
FIG. 7 is a side cross-sectional view of the steam generator as employed in this system.

With reference now to the included drawings, particularly FIG. 7, the preferred embodiment of the new and improved steam generator embodying the principles and concepts of the present invention and generally designated by the reference numeral 10 will be described.

A steam generator system for allowing a user to safely and efficiently produce steam is disclosed. The system comprises several components, in combination.

First provided is a submersible burner compartment 14. The submersible burner compartment has a lower portion, a shaft portion 16, a shaft portion 18, and an upper portion 20. The lower portion of the submersible burner compartment has a cylindrical configuration with a water feed pipe 22 Water enters lower portion and fills the burner compartment.

In an alternate embodiment the configurations of the burner compartment may be any one of a plurality of geometrical configurations.

The shaft portion of the submersible burner compartment is coupled at 17 to the lower portion in an orientation that is perpendicular to the water feed pipe. The shaft portion has a hollow tubular configuration. The shaft portion has at least one burner subassembly 24 with an associated submersible ignition means 26. The burner subassembly also has an associated infrared flame monitoring subassembly 28. The burner subassembly, the monitoring system and ignition means are all housed within the shaft portion of the submersible burner compartment. When the shaft portion 18 is filled with water, the burners 24 are all submerged in the liquid. The infrared subassembly is electronically coupled to a monitoring device 30. The burner assembly has a fuel feed pipe 32 coupled thereto.

The upper portion 18 of the burner compartment has a cylindrical configuration. There is at least one baffle plate 34 located therein. The upper portion has a steam exhaust pipe 36 coupled thereto.

In an alternate embodiment the shaft portion and the upper portion, like the lower portion, may be any one of a plurality of geometric configurations.

The system also comprises a super heater compartment 40. The super heater compartment has a generally hollow tubular configuration with a lower end 42 and an upper end 44. The steam exhaust pipe is coupled to the lower end of the super heater compartment, providing a passageway for steam from the burner compartment to the super heater compartment.

The super heater compartment has with at least one burner subassembly 46 located therein. There is an associated submersible ignition means 48 and an associated infrared flame monitoring subassembly for each burner subassembly. The burner and secondary ignition means and infrared secondary flame monitoring subassembly are all housed within the super heater compartment 40. The infrared subassembly is electronically coupled to a monitoring device 52.

The burner subassembly has a fuel feed pipe 56 coupled there to. The super heater compartment has a steam exit pipe 58 coupled to the upper end of the super heater compartment.

The power generation need-based system that may used in conjunction with a steam generator, described below, is a variable process of generating electricity. The use of the steam, Hydrogen gas, Oxygen gas, and electricity produced by the system is determined according to supply, need and value. The system, as herein described, utilizes electronic components, such as wiring, radio frequency generation and reception, infrared emission and sensing, and a computer having a program, memory and the capability to receive data and control devices.

The process of storing energy by converting it to Hydrogen and then using a regeneration system such as fuel cells or internal combustion engines (ICE) is not new. The Tennessee Valley Authority (TVA) set up this type of system in 1992 using fuel cells as their regenerator. Stuart Energy utilizes an ICE (internal combustion engine) set up that helped to manage the Midwest-Northeast wide area power failure in 2003.

The TVA system was shut down because it was too expensive to operate. This was only partly because the TVA was using very expensive fuel cells. It was also due to the fact that the electricity that was created could only be cost justified at peak times of the year.

The process/system as described herein is not only designed to store energy, but to make the storage profitable by determining at different times of the hour, day, month or year what the most profitable use of the energy is. This is determined by addressing the question of what is the greatest present need. The need, therefore, becomes a variable, and not a constant.

The system as described herein uses energy from various renewable sources or from the commercial electricity grid, depending on availability and price. It uses the electricity to maintain draw, make Hydrogen and Oxygen gases, or both.

The system utilizes a series of controls that, in turn, utilize sensors and market data from a variety of resources to compare variables and make decisions on where to use energy resources based on a hierarchy of supply, need, and value.

The variables for the decision can be set according to the energy needs and market demands in a local area. Steam can be made as part of the process, and can also be made independently of electricity generation, if required if the need variable so indicates. Steam can be used in secondary and tertiary applications, such as area heating, steam-chiller cooling, hot water generation, or other industrial applications. The system can be configured with a steam generator system, also known as a hydrogen-oxygen boiler system. The system can also be configured with an internal combustion engine (I.C.E.), or fuel cell.

The system will be flexible as to sales of byproduct, whether the byproduct is steam, heated water, electricity generation, or Hydrogen and Oxygen that is produced by the system. That is to say, if the market for Hydrogen or Oxygen is not going to be profitable, production of those gases will be halted.

The process-control system will weigh the variables of supply, need, and value to decide the 'highest and best use' for the energy or byproducts so produced. The variable 'need' can be calculated from the draw requirements of a building, as a signal from a larger control system, such as that of an electricity power utility. The system is designed to accommodate smaller building-size systems up to huge commercial power-plant operations.

The energy industry faces a challenge in meeting growing demands while reducing emissions and maintaining competitive pricing. One approach is to use low cost, off-peak electricity as the fuel for electrolyzers that will produce Hydrogen and Oxygen. The Hydrogen and Oxygen are captured and stored near the electrolysis equipment. The Hydrogen can be used in a variety of applications.

Such a cycle is not, itself, a new idea. Other power generating entities have tried this approach, using fuel cells to regenerate electricity. A disadvantage of this approach, under the existing technology, is the expense of the required fuel cells. A way to avoid this disadvantage is to burn the Hydrogen and Oxygen in a steam generator, as described herein, to produce steam for an electricity generating turbine.

Hydrogen and Oxygen can be used as a fuel to produce a flame under water, such as in the currently described steam generating system. The burning of the Hydrogen and Oxygen produces a heating of the water. The hot water becomes steam. The steam can be used for purposes, such as:

a. turning an electricity producing turbine;

b. providing an absorption chiller to produce chilled water for cooling a building;

c. providing heat input to a desiccant energy or enthalpy wheel;

d. providing hot water to buildings;

e. providing steam heating for buildings.

Hydrogen and Oxygen can be sold commercially during seasons when electricity demand is lessened. The result of such off-season energy use is that electrolyzers would use lower priced energy to produce a form of energy storage that could be employed during peak energy demand periods. Not only would energy usage be more efficient, but the production of harmful emissions would be decreased.

The current invention increases efficiency and decreases pollutants by:

a. allowing all of the heat produced by the combustion of the Hydrogen and Oxygen to be directly absorbed by the water;

b. diminishing the contact of Nitrogen with Oxygen during the burning process, and thereby lessening the production of NOX;

c. completely utilizing the heat produced by the reaction for the production of steam.

The end result is a highly efficient boiler that produces little, if any, harmful emissions. As noted above, the steam can then be used for any one of a myriad of applications, including heating and cooling application, as well as electricity production.

Underwater welding research and experience has shown that one can produce a hot flame under water. The advantage of such an submerged burning is that no atmospheric Nitrogen is allowed to interact with the reactants. It should be noted that the use of distilled, or non-ionized water is preferred, as it contains no minerals or dissolved solutes.

The system of the present invention uses energy from various renewable sources or the commercial electricity grid depending on availability and price. It uses the electricity to maintain draw, make Hydrogen and Oxygen gases or both in utility or industrial power-plant operations.

The present system constantly compares variables of supply, need, and value of the different energy sources, and the efficiency of storage devices and energy conversion devices-dynamically determining the highest and best use of the electricity inputs.

While in operation, the currently disclosed system resembles a large loop of sensor readings, decision points and computer controlled activities. However from the human standpoint, the process starts with a user, usually a company or organization, and one or more sources of electricity.

Figure 1:
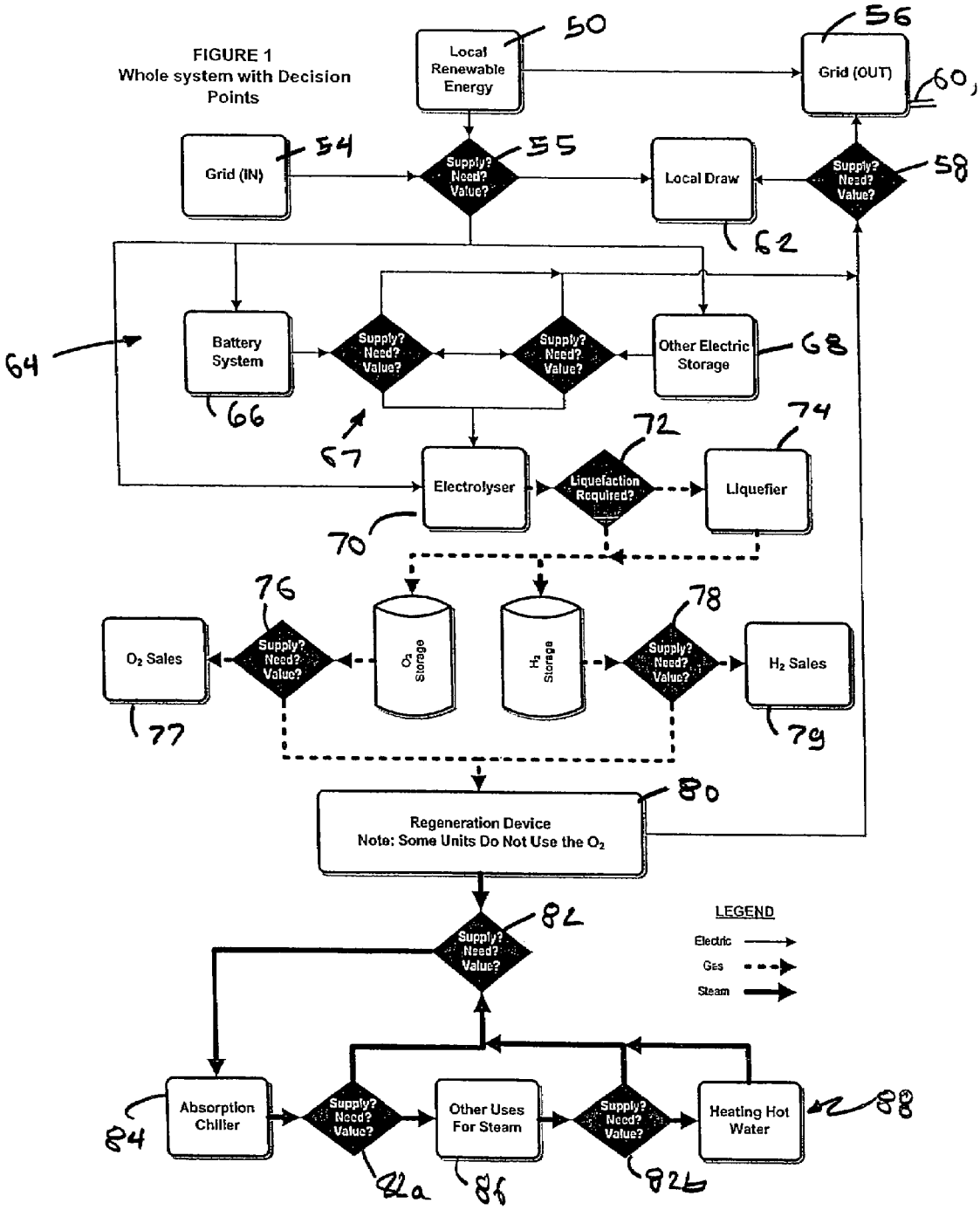
FIG. 1 is a diagram of the energy need-based distribution system in which the steam generator would be employed.

The system software by means of sensors notes whether the electricity comes from Local Renewable sourced generation, box 50 called Local Renewable on FIG. 1, such as from wind turbines or solar panels (or other source) or the commercial electricity grid, box 52 called Grid IN on FIG. 1.

If the Local Renewable source 50 is producing electricity, the control software compares at 55 to see if the Local Renewable electricity would be profitable to send to the commercial electricity grid, box 56 called Grid OUT on FIG. 1. At this point the system compares Value in comparison with the Grid market price for electricity at that moment. If, because of prices in the electricity marketplace, it would be profitable to sell electricity, then the system checks at 48 to ensure that the means exists and is operational, Grid OUT, to send electricity to the grid as indicated at 60. This operation depends on the system being programmed with such a parameter, on physical means to connect to the Grid, and on rolling agreements having been negotiated with the connecting power utility.

If price comparison shows that it is not profitable to sell electricity at that moment, then the system checks by means of sensors to decide if it should send the Local Renewable electricity to Local Draw, see diagram box 62 by that name on FIG. 1, or to the local energy storage sub-system 64, shown as the group of boxes on FIG. 1 that are labeled Battery System 66 and so on downwards. To do this the system must by means of sensors determine the following inputs for, including but not limited to:

1) is there connection to Local Draw, e.g. sine inverter from direct current to alternating current or other equipment;
2) if there is connection to Local Draw, is there need, how much power does the user utilize, and does the supply match the need? and;
3) is there no Local Draw but only local energy storage?

If there is no Local Draw and no local energy storage subsystem then the example system would probably only accommodate Grid IN 54 and Grid OUT 56.

Once the system has sensed what the connections are, in the case when it is not profitable to send electricity to Grid OUT, then the computer uses programmed parameters to decide where to send the electricity. If there is no Local Draw connection 62 or the need for Local Draw in that moment is zero, then the system at that decision point sends the electricity to the Battery System 66 for storage. This would usually be a large capacity UPS (Uninterruptible Power Supply). The system can also decide to send some of the power to Local Draw 62 and some to Battery System 66 for storage. If the Battery System is intended as Uninterruptible Power Supply then the control system can by means of sensors determine whether the Battery System is recharged to 100% of capacity. The control system can keep a historical database to monitor battery efficiency. The system can also maintain a historical database to monitor energy usage and thus be ready to, for instance, provide more energy at peak hours, less energy at off-peak hours, or make a report, 'alert', if the Local Draw 62 is anomalous because of usage that could signal an equipment malfunction or other noteworthy condition.

If the Battery System 66 is fully charged then the system checks at 67 the value in terms of energy market prices at that moment in terms of the price to efficiency ratio of the other connected storage device(s)68. The system then decides whether the return amount of electricity justifies sending the electricity to one or another specific storage device.

If the Battery System 66 is fully charged and the Other Energy Storage devices 68 are fully charged, the system must compare at 67 to the energy market prices for that moment and decide whether to send electricity back to the beginning part of the system, Local Draw 62 or Grid OUT 66 or to send it to a connected Electrolyzer 70. This decision point compares the value for electricity with the value for Hydrogen and Oxygen that the electrolyzer would produce. If electricity is less profitable for use, for Local Draw 62 or Grid OUT 56, at that moment in terms of the price to efficiency ratio, then the system sends the electricity to the electrolyzer 70. The gases are electrolyzed from water, and therefore water becomes a system costing factor to be calculated.

Once the Hydrogen and Oxygen gases are made in the electrolyzerb 70, as known to the system by means of sensors, then the system comes to another decision point 72, if this is programmed in as a system parameter. If a Liquefier 74 is connected to the system, it determines some or all of the following;

1) is the liquefier operational according to safety parameters?
2) what is the price to efficiency ratio at that moment?
3) how much Hydrogen and Oxygen gases are already in storage and is there room for more to be stored?
4) is the commodity market price for such gases at levels that make selling them profitable?

Depending on the liquefier design, the Hydrogen and Oxygen may be liquefied simultaneously or separately, and the control software will sense, monitor and control these functions. Once the Hydrogen and Oxygen are liquefied, if available storage is becoming full and the commodity price of the gases is not high enough to send the gas(es) out to customers, see 77, 79, by whatever pipeline or transportation system might be used, then the system decides at 76, 78 whether to send the gases to a connected regeneration device 80 to make electricity.

The regeneration device 80 could be the Hydrogen-Oxygen fueled immersion boiler 10 as described herein. The boiler could be connected to a steam turbine electric generator. The system balances the supply of the gases as required. Once the system decides to make electricity, it must, again, check value versus need ratio of the energy market price and requirement for electricity to determine if the electricity should be used for Local Draw 62 or sent to Grid OUT 56.

If the system decides not to make electricity because both need and value of that form of energy are too low, then it will compare at 82, 82*a* and 82*b* the need and value of steam for the uses shown at the bottom of FIG. 1: Absorption Chiller 84 for air conditioning/cooling, Other Uses For Steam 86, Rankine cycle generator, desiccant energy or enthalpy wheel or industrial uses such as heating buildings or industrial processes, heating hot water for various uses including personal use, or recycling hot water back into the regeneration unit, as indicated at 88.

The system might choose to instruct the Hydrogen-Oxygen fueled immersion boiler 10 not to utilize the connection to its co-located steam turbine electric generator, but to make smaller and cooler amounts of steam for the purpose of 'steam chiller' cooling instead.

Figure 2:
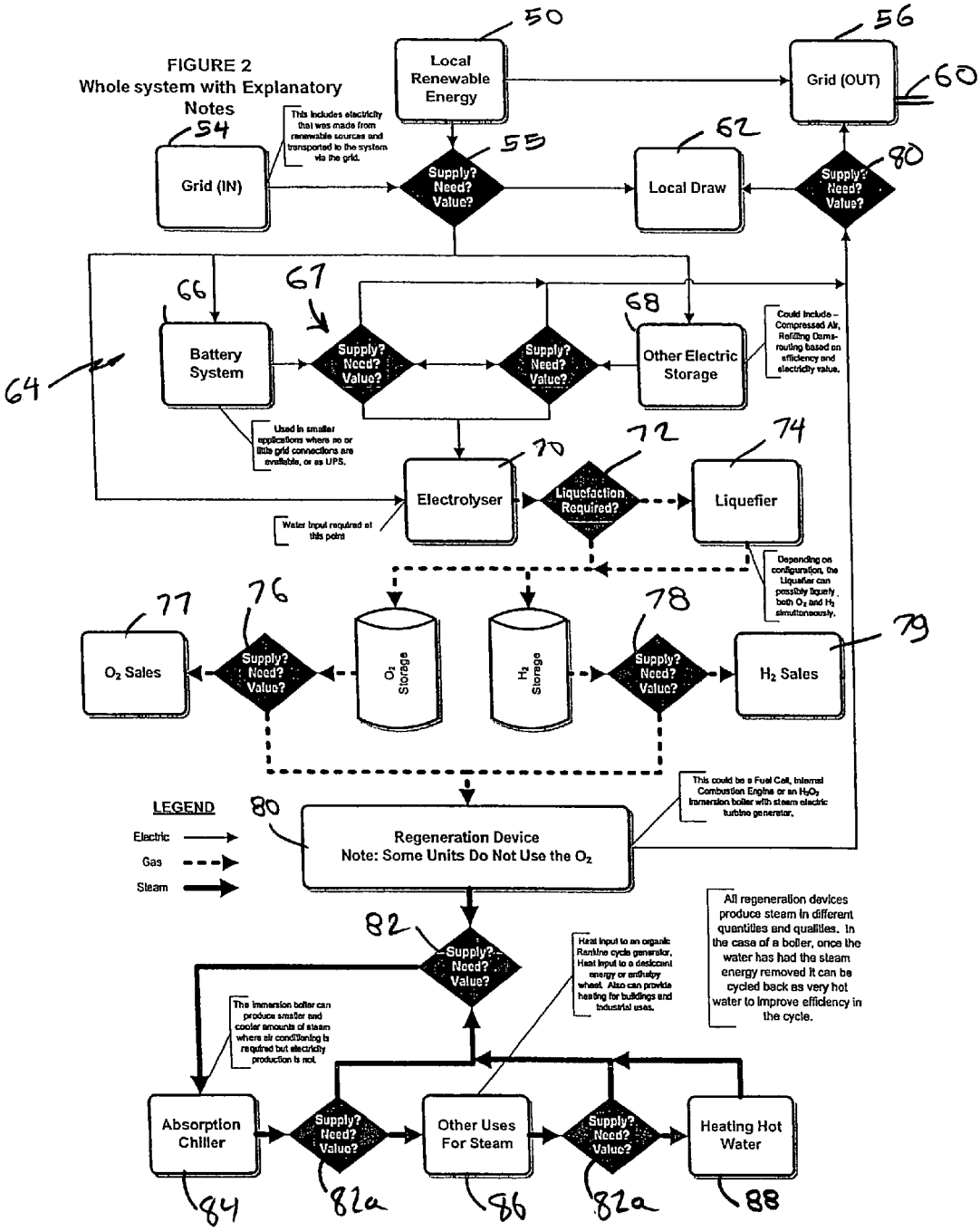
FIG. 2 is an annotated diagram of the energy need-based distribution system in which the steam generator would be employed.

The foregoing is a description of the Hydrogen-Oxygen Automatic Electric Energy Transfer Control and Arbitrage System, as shown in FIG. 1. The whole system is also shown in FIG. 2 with explanatory notes.

Figure 3:
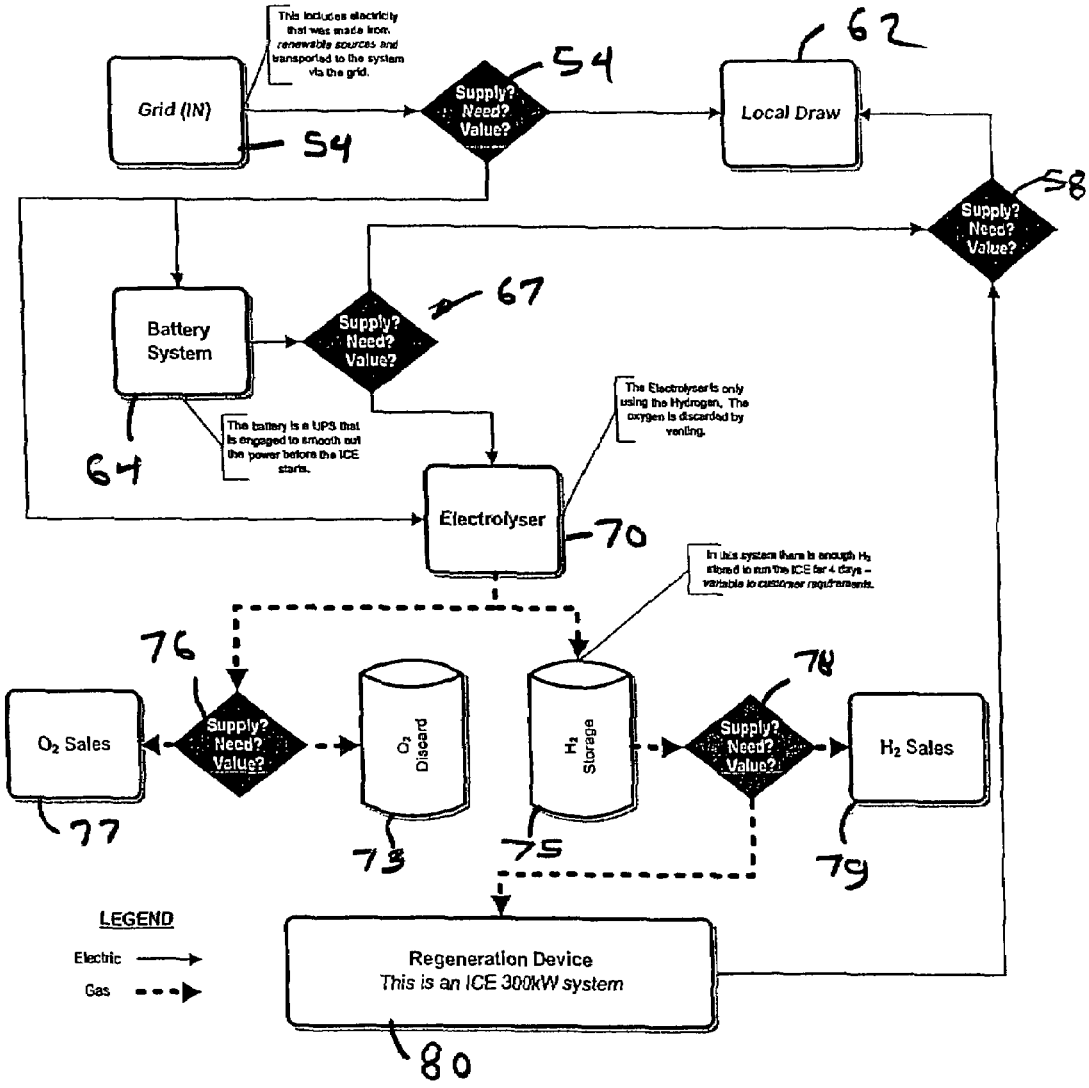
FIG. 3 is a diagram of an emergency power need configuration of the system.

FIG. 3 is an example showing an "emergency power" configuration of the process. In this configuration, there is no Grid OUT option. The company using this configuration desires only standby power in case of a power outage of the electrical grid. The battery system 64 is intended as an UPS and is always kept charged to 100%. The UPS provides power until the Regeneration Device 80, an Internal Combustion Engine 300 kW generator, starts. The UPS also smooths the supply to prevent power spikes due to I.C.E. start-up. The electrolyzer 70 makes only enough Hydrogen and Oxygen to keep the Hydrogen storage tanks full, and the Oxygen is discarded as at 73. The I.C.E. runs on hydrogen, much as a hydrogen car engine does, and the company is only required to store enough Hydrogen to run the I.C.E. generator for several days of full-time Local Draw of electricity. The amount of time depends on the user's needs, the volatility of Grid IN power supply and the user's storage capacity. This system can provide surplus Hydrogen to run vehicles or to sell, see 79, as a commodity if so configured, however such a surplus to this "emergency power" configuration would always be "on call" in case of an extended power grid outage such as the Power Failure 2003 event.

Figure 4:
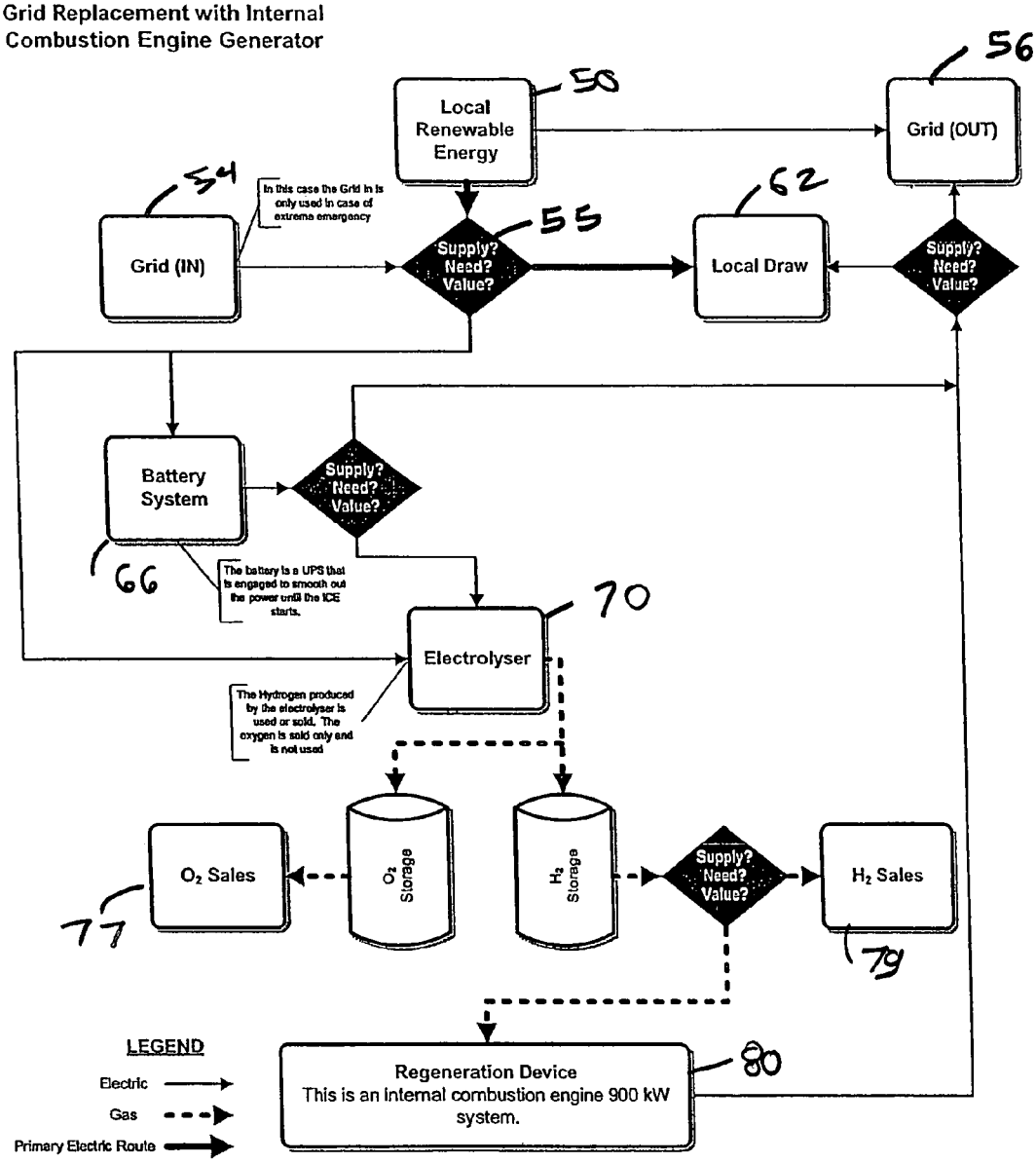
FIG. 4 is a diagram of the system utilizing an internal combustion engine generator.

FIG. 4 is an example showing a "grid replacement" configuration of the process, using internal combustion engines. In this case the Grid IN connection 54 is only used in case of extreme emergency. The Regeneration Device 80 is an I.C.E. 900 kW system that runs on Hydrogen. The UPS battery 66 smooths out the power supply until the I.C.E. generator 80 is fully started. The Electrolyzer 70 makes Hydrogen and Oxygen and the Oxygen is sold, see 77. The Hydrogen, if not used, is sold if commodity prices warrant, see 79. Although there is a connection for Grid OUT 56, the priority would not be to sell any electricity to the local power utility so long as the supply did not exceed the need for the Local Draw 62.

Figure 5:
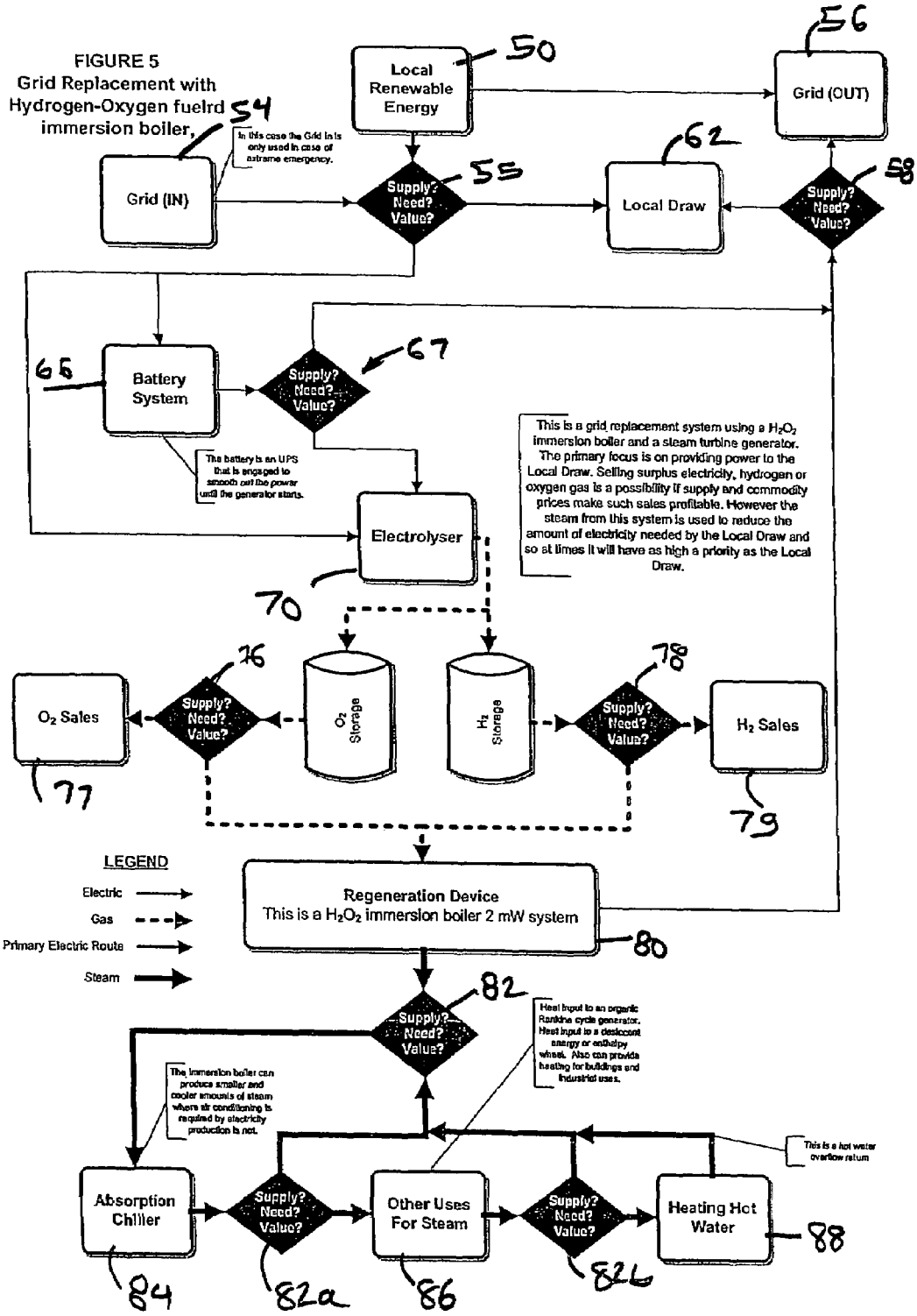
FIG. 5 is a diagram of the system utilizing a Hydrogen-Oxygen fueled immersion boiler as is disclosed herein.

FIG. 5 is an example showing a "grid replacement" configuration of the process, using the Hydrogen-Oxygen fueled immersion boiler 80. In this case the Grid IN connection 54 is limited to use in the case of extreme emergency. The immersion boiler 80 provides 2 mW of electricity and the priority would not change selling energy to the connected Grid OUT 56 unless there were a supply that was surplus to need. The UPS battery 66 smooths out the power supply until the immersion boiler 80 and steam turbine generator is fully started, which might take 30 to 40 minutes.

This grid replacement system has a primary focus on providing power for the Local Draw 62. Sales of surplus electricity, Hydrogen or Oxygen gas is only done if it does not impair the ability of the system to generate electricity for local use. The steam from the immersion boiler can be used either as a byproduct of electricity generation or independently as a primary product. Since steam-chiller cooling replaces the need for electrical-process air conditioning and thus reduces the primary draw by as much as 35%, when atmospheric conditions warrant, the absorption chiller 84, and associated enthalpy wheel air treatment, will have as high a priority in system decision-processing as providing electricity for the Local Draw 62. The absorption chiller sub-system includes hot water heating 88 and hot water overflow return into the regeneration system.

Figure 6:
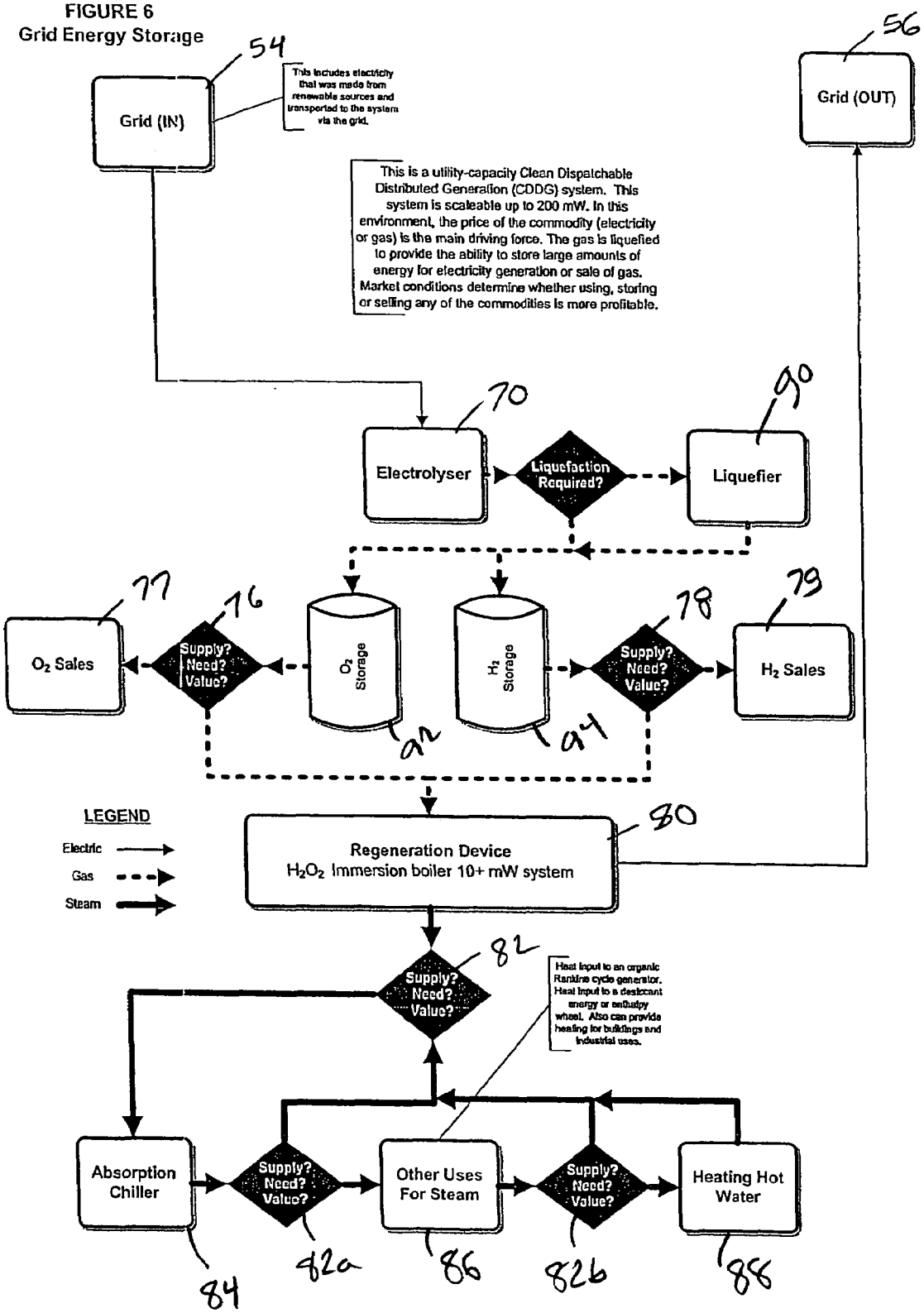
FIG. 6 is a diagram of the system utilizing grid energy storage.

FIG. 6 is an example showing a "grid energy storage" configuration of the process, using the Hydrogen-Oxygen fueled immersion boiler 80. This "utility size" version of the system is herein referred to as "CDDG" or "Clean Dispatchable Distributed Generation". The example shows a Hydrogen-Oxygen fueled immersion boiler 80 of 10 or more mW capacity. This system is scaleable up to 200 mW. The utility is the Grid and consequently the Grid IN 54 and Grid OUT 56 connections are not subject to the complex decision-points common to the other configurations. In this environment the price of the commodity is the main driving force. Very simply, if the selling price of electricity is higher than the selling price of the various byproducts such as Hydrogen, Oxygen or steam for absorption—chiller cooling or building heating, for clients of the utility, then the electricity will be the primary focus. If the byproducts, especially Hydrogen gas for transportation or other uses, are more profitably used as commodities for sale, then that will be the primary focus. This configuration includes liquefaction of Hydrogen and Oxygen gases, see 90, plus provision for large-scale storage tanks 92, 94 capable of holding vast quantities of gases.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A steam generator system comprising:

a. a submersible burner compartment having a lower portion, a shaft portion, and an upper portion, the lower portion having a water feed pipe whereby water may enter the lower portion being coupled to the lower portion; and b. at least one burner subassembly with an associated submersible primary ignition means in the shaft portion, the burner subassembly also having an associated infrared primary flame monitoring subassembly, the primary monitoring system and primary flame ignition means all being housed within the shaft portion of the submersible burner compartment, whereby when the shaft portion is filled with water, the burners are all submerged, the infrared subassembly being electronically coupled to a monitoring device with the burner assembly having a fuel feed pipe coupled thereto.

2. The system as set forth in claim 1, wherein the upper portion of the burner compartment has at least one baffle plate located therein with the upper portion having a steam exhaust pipe coupled thereto.

3. The system as set forth in claim 2, further including a super heater compartment having a generally hollow tubular configuration with a lower end and an upper end and with the steam exhaust pipe coupled to the lower end of the super heater compartment thereby providing a passageway for the steam from the burner to the super heater compartment, the super heater compartment having at least one burner subassembly located therein.

4. The system as set forth in claim 3, further including an associated submersible secondary ignition means and an associated infrared secondary flame monitoring subassembly for each burner subassembly, the burner and ignition means and infrared monitoring subassembly all being housed within the super heater compartment with the infrared subassembly electronically coupled to a monitoring device.

5. A steam generator system for allowing a user to safely and efficiently produce steam, comprising, in combination:

a. a submersible burner compartment having a lower portion, a shaft portion, and an upper portion, the lower portion having a cylindrical configuration with a water feed pipe whereby water may enter a lower portion and fill the burner compartment, the shaft portion being coupled to the lower portion in an orientation that is perpendicular to the water feed pipe, the shaft portion having a hollow tubular configuration;

b. at least one burner subassembly with an associated submersible primary ignition means in the shaft portion, the burner subassembly also having an associated infrared primary flame monitoring subassembly, the primary flame monitoring means and primary ignition means all being housed within the shaft portion whereby when the shaft portion is filled with water, the burners are all submerged, the infrared monitoring subassembly being electronically coupled to a primary monitoring device and a fuel feed pipe coupled to the burner subassembly;

c. the upper portion of the burner compartment having a cylindrical configuration with at least one baffle plate, located therein, the upper portion having a steam exhaust pipe coupled thereto;

d. a super heater compartment having a generally hollow tubular configuration with a lower end and an upper end and with the steam exhaust pipe coupled to the lower end of the super heater compartment thereby providing a passageway for steam from the burner compartment to the super heater compartment, the super heater compartment having at least one burner subassembly located therein; and e. an associated submersible secondary ignition means and an associated infrared secondary flame monitoring subassembly for each burner subassembly, the burner, secondary ignition means and infrared secondary monitoring subassembly all being housed within the super heater compartment with the infrared subassembly electronically coupled to a secondary monitoring device.

6. A steam generator system comprising:

a. A burner compartment for receiving feed water which is to be converted into steam;

b. A burner subassembly having a burner positioned within the burner compartment, whereby the burner subassembly is submerged within the water in the burner compartment;

c. An ignition assembly within the burner compartment for igniting the burner; and d. a flame monitoring system including an infrared flame monitoring subassembly within the burner compartment and coupled to an external monitoring system for monitoring the burner while feed water is in the burner compartment.

7. The steam generator of claim 6, the burner compartment further including a discharge chamber whereby steam produced in the burner compartment is released therefrom.

8. The steam generator of claim 7, wherein the discharge chamber includes a discharge port and at least one baffle plate positioned between the burner subassembly and the discharge port.

9. The steam generator of claim 6, further including a secondary burner compartment for receiving the steam generated in the burner compartment and discharged through the discharge port, the secondary burner compartment including:

a. A burner subassembly having a burner positioned within the burner compartment, whereby the burner subassembly is submerged within the water in the burner compartment;

b. An ignition assembly within the burner compartment for igniting the burner.

10. The steam generator of claim 9, further including a monitoring system within the burner compartment for monitoring the burner while feed water is in the burner compartment.

11. The steam generator of claim 6, wherein the burner compartment includes a lower portion, a generally vertical shaft portion, and an upper portion, the lower portion having a water feed inlet for receiving and introducing feed water into the burner compartment and an upper portion for discharging steam from the burner compartment, with the burner subassembly positioned in the generally vertical shaft intermediately of the lower portion having the water feed inlet and the upper portion for discharging steam.

12. The steam generator of claim 6, further including a fuel line in communication with the burner subassembly and with a source of fuel external of the burner compartment for feeding fuel to the burner subassembly within the burner compartment.

* * * * *